US006530478B1

(12) United States Patent
Kanoyadani et al.

(10) Patent No.: US 6,530,478 B1
(45) Date of Patent: Mar. 11, 2003

(54) TABLET DISPENSER

(75) Inventors: Toshimitsu Kanoyadani, Tokyo (JP); Tadaaki Iwamoto, Tokyo (JP)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 09/857,987

(22) PCT Filed: Dec. 6, 1999

(86) PCT No.: PCT/JP99/06819

§ 371 (c)(1),
(2), (4) Date: Aug. 9, 2001

(87) PCT Pub. No.: WO00/35771

PCT Pub. Date: Jun. 22, 2000

(30) Foreign Application Priority Data

Dec. 11, 1998 (JP) ..... 10-352574

(51) Int. Cl.[7] ..... B65D 83/04; B65D 43/20
(52) U.S. Cl. ..... 206/538; 206/445; 220/345.3
(58) Field of Search ..... 206/538, 539, 206/445, 0.83, 0.84; 220/507, 345.1, 345.2, 345.3, 345.4

(56) References Cited

U.S. PATENT DOCUMENTS

| | | | | |
|---|---|---|---|---|
| 2,362,835 A | | 11/1944 | Lauer | |
| 2,367,019 A | | 1/1945 | Haag | |
| 2,582,821 A | * | 1/1952 | Duell et al. | 220/345.3 |
| 2,643,762 A | * | 6/1953 | Neilsen | 206/0.83 |
| 3,033,355 A | * | 5/1962 | Van Sickle | 206/539 |
| 3,397,770 A | * | 8/1968 | Howard et al. | 206/539 |
| 4,465,191 A | | 8/1984 | Darbo | |
| 5,242,076 A | * | 9/1993 | Gibilisco | 206/538 |
| 5,608,940 A | | 3/1997 | Panyon, Jr. | |

* cited by examiner

*Primary Examiner*—Bryon P. Gehman
(74) *Attorney, Agent, or Firm*—Barry H. Jacobsen; Evan J. Federman

(57) ABSTRACT

The object of the present invention is to provide a tablet case which can eliminate the disadvantage that the tablets in the case are broken by mutual collision therebetween when there remain a smaller number of tablets in the case, and which makes it possible to readily take out a desired number of tablets therefrom. An elongated tablet case is provided which accommodates a plurality of the tablets. The tablet case has a case body, a cover, and knots. The case body is provided with a plurality of narrow groove-like recesses, each one accommodating one tablet, which are disposed in parallel with one another in one row along the longitudinal direction of the case body. The cover is fitted to the case body slidably along the longitudinal direction. The knots temporarily lock the cover relative to the case body every time the cover is slid by a predetermined distance relative thereto.

8 Claims, 6 Drawing Sheets

Prior Art

TABLET DISPENSER

TECHNICAL FIELD

The present invention relates to a tablet case for accommodating, for example, circular-, triangular- or square-shaped thin plate-like tablets (such as confectionery and medicines).

BACKGROUND ART

As a tablet case for accommodating tablets, there has been conventionally known a slender cylindrical case as shown in FIG. 1. The tablet case has a slender cylindrical body 1 having a bottom, and a cap 2 for closing the top of the cylindrical body 1; and a plurality of tablets 3 are fully stacked therein with their bellies being superposed on one another.

The tablets are unrestrictedly housed in such a tablet case, so that, when only a few tablets remain in the case, the tablets are largely shaken up and down in the case while being carried and they are collided by one another at their bellies, thus inconveniently cracking themselves.

There is also another problem as follows. That is, when the mouth of the case is directed downward with an intention to take out only one or two tablets from the case, many tablets may drop out therefrom unintentionally.

It is, therefore, an object of the present invention to provide a tablet case which can eliminate a disadvantage that the tablets in the case are broken by mutual collision therebetween when there remain a smaller number of tablets in the case, and which makes it possible to readily take out a desired number of tablets therefrom.

DISCLOSURE OF THE INVENTION

In accomplishing the object of the present invention, there is provided a tablet case which is elongate and which accommodates a plurality of tablets, characterized in that there are provided: a case body which is provided with a plurality of slot grooves each of which accommodates a tablet, wherein the plurality of slot grooves are arranged in a row in a longitudinal direction of the case body with a state in which the plurality thereof are in parallel with each other; a cover which is slidably mounted on the case body having a pair of ends in the longitudinal direction of the case body, and which extends from one of the pair of ends to the other of the pair of ends of the case body in the longitudinal direction; and a clicking means for temporarily locking the case body and the cover relative to each other every time the cover is slid by a predetermined distance relative to the case body.

In the tablet case with the above structure, tablets are individually held in the slot grooves one by one. Therefore, even when only a few tables remain in the case, there never occurs such a disadvantage that the tablets are thrown against one another to crack themselves within the case. Further, it is possible to temporarily hold the cover at predetermined positions relative to the case body, and therefore, the length by which the cover is slid to open the tablet case can be freely controlled at one's option in accordance with a desired number of tablets to be taken out. In this sense, it is preferable for the above predetermined distance to be approximately equal to the width of one slot groove (i.e., approximately equal to the thickness of each of tablets accommodated in the case).

It is preferable for the tablet case of the present invention to be provided with a partition wall for dividing an interior space of the tablet case into a pair of chambers at a central part of the longitudinal direction of the case body. It is also preferable for the tablet case of the present invention to be provided with a stopper means for preventing an overlapping length of the cover and the case body from being less than a half of an entire length of the tablet case.

Having the above structure, the tablet case can accommodate different kinds of tablets in the two partitioned chambers, respectively. Further, by providing the stopper means, it becomes possible to slide the cover along the longitudinal direction of the tablet case between "a position at which one of the chambers is fully opened" and "a position at which the other chamber is fully opened".

In the present invention, it is preferable that a plurality of knots are provided linearly along an entire length of an inner face of the cover so that the knots are successively engaged with each of edges of side walls which are provided at the pair of ends of the case body in the longitudinal direction, thereby functioning as the clicking means. In such a case, each of the knots has a length, in the longitudinal direction of the tablet case, substantially equal to the above predetermined distance. In the case that the clicking means are composed of the linearly provided knots, it is preferable that a projection higher than the knots is provided at a center of the knots so that the projection comes into contact with one of the side walls of the case body, thereby functioning as the stopper means.

In the tablet case of the present invention, it is preferable that at least one of a surface of the case body and a surface of the cover is made an uneven surface which functions as a grip means. This grip means prevents one's fingers from slipping on the tablet case when one opens or closes the tablet case.

BEST MODE FOR CARRYING OUT THE INVENTION

The embodiment of the present invention will be described in detail below with reference to the accompanying drawings.

Figure 1:
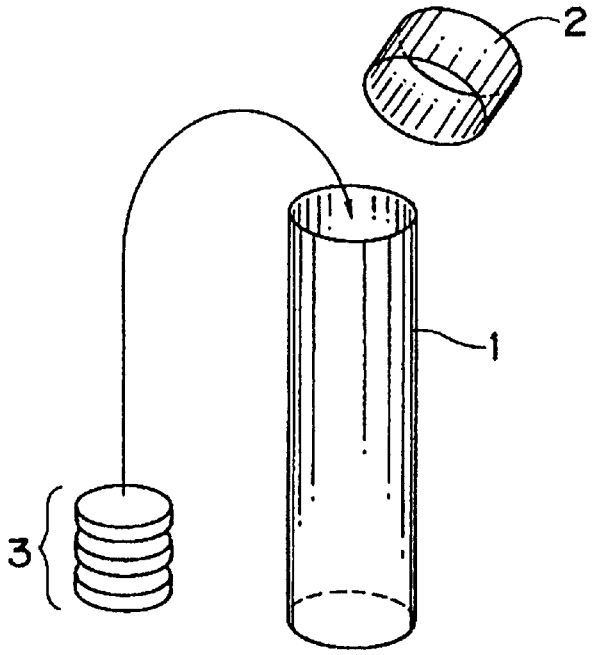
FIG. 1 is a schematic perspective view of a conventional cylindrical case for accommodating tablets.
Figure 2:
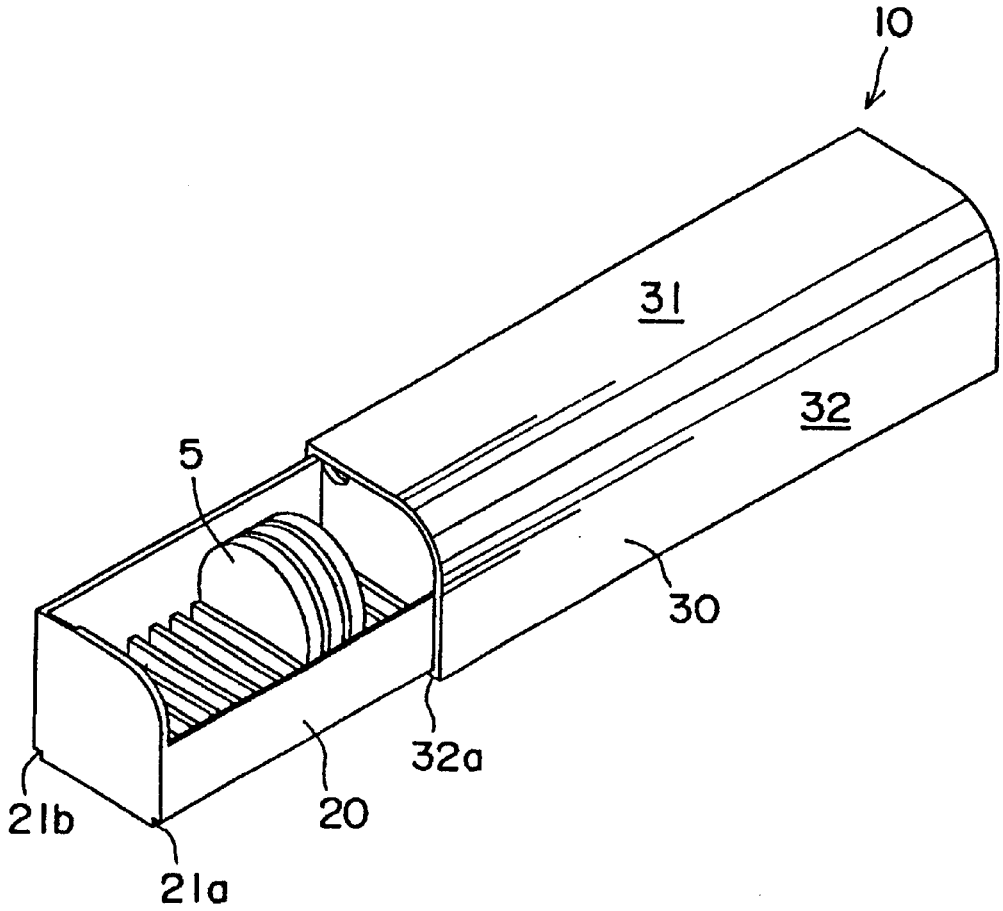
FIG. 2 is a perspective view of a tablet case according to one embodiment of the present invention.

FIG. 2 is a perspective view of a tablet case 10 according to one embodiment of the present invention. The tablet case 10 has an elongated case body 20 (see FIG. 3) and a cover 30 (see FIG. 4) which is fitted to the case body 20 slidably in a longitudinal direction so as to open or close the case body. The case body 20 and the cover 30 are assembled for use as the tablet case.

Figure 3:
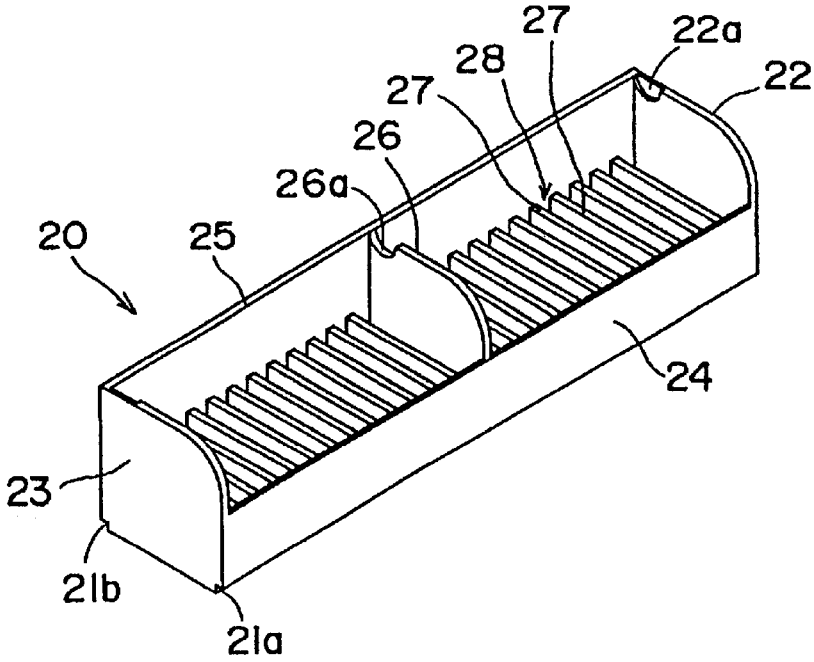
FIG. 3 is a perspective view of the case body of the tablet case shown in FIG. 2.
Figure 4:
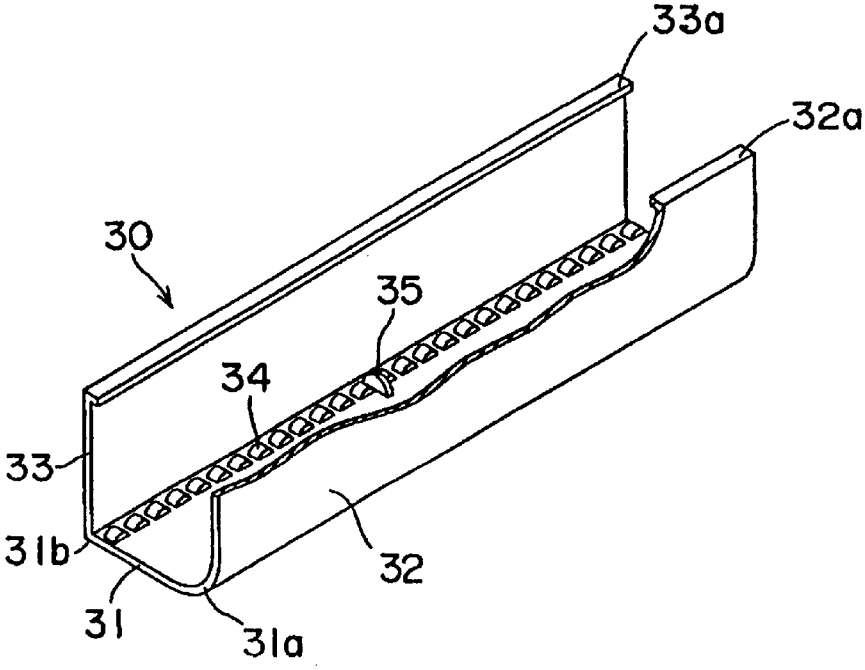
FIG. 4 is a partially broken perspective view of a cover of the tablet case shown in FIG. 2.

FIG. 3 is a perspective view of the case body 20, and FIG. 4 is a partially broken perspective view of the cover 30 showing the interior thereof. It is seen that the cover 30 has a length equal to that between one end and the other end of the case body 20 in the longitudinal direction.

The case body 20 has a bottom wall 21 (see FIGS. 5 and 9), side walls 22, 23 at both sides of the bottom wall 21 in the longitudinal direction, and a front wall 24 and a rear wall 25 which adjoins the side walls 22, 23, respectively. These walls surround an overall periphery of the bottom wall 21. A plurality of partition plates 27 are disposed at regular intervals in parallel with one another, extending in a direction perpendicular to the longitudinal direction of the case body 20 between the front wall 24 and the rear wall 25. As a result, a plurality of narrow groove-like recesses (slot grooves) 28 are formed between the partition plates 27, and as seen in FIG. 3, the narrow groove-like recesses 28 are disposed in parallel with one another and aligned in a row along the longitudinal direction of the case.

The narrow groove-like recess 28 has a width which is so determined as to be slightly larger than the thickness of one tablet, and the interval between the front wall 24 and the rear wall 25 is so determined as to be slightly larger than the diameter of the tablet. Thus, each one tablet 5 is held in each one narrow groove-like recess 28 (see FIG. 2).

As shown in FIG. 4, the cover 30 has a U-shaped section, and it has a top wall 31, a front wall 32 and a rear wall 33. The front wall 32 is connected to the top wall 31 via a round corner part 31*a*, and the rear wall 33 is connected to the top wall 31 via a normal corner part (crook part) 31*b*. Each of the edges 32*a* and 33*a* of the front and rear walls is bent, in a hook-like shape, in a direction in which they approach with each other, so as to serve as a slider engagement part. That is, when the case body 20 and the cover 30 are assembled to each other as shown in FIG. 2, the slider engagement parts 32*a* and 33*a* are fitted to a pair of stepped portions 21*a* and 21*b* formed on the bottom wall 21 of the case body, respectively. Thus, the cover 30 can slide relative to the case body 20.

Figure 5:
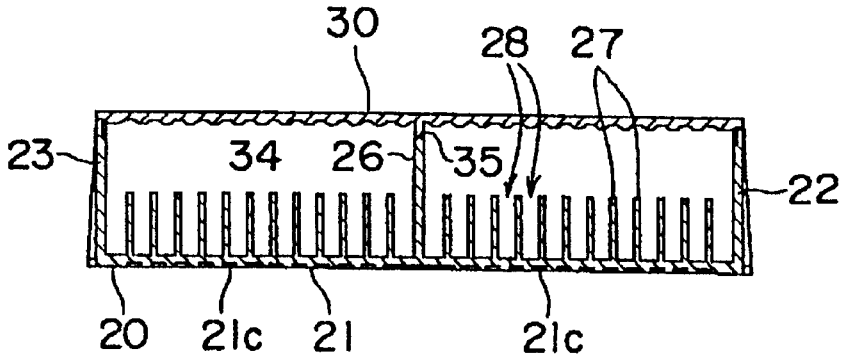
FIG. 5 is a longitudinal sectional view of the tablet case which has been assembled, its being taken along a plane including a row of knots.

A plurality of knots (bumps, projections) 34 are formed on an inner face of the cover top wall 31 so that the knots are aligned in one straight row along the longitudinal direction of the case. The length of one knot in the longitudinal direction of the case is approximately equal to the width of one narrow groove-like recess 28 as shown in FIG. 5. In this connection, FIG. 5 is a longitudinal sectional view of the assembled tablet case 10, which shows a section including the row of knots 34.

When the cover 30 is slid relative to the case body 20, the knots 34 are engaged with the upper edge of the side wall 22 or 23 of the case body one after another. As the cover 30 slides on, each of the knots 34 goes beyond the upper edge of the side wall one by one. Thus, a user can hear and feel the knots 34 click every time the knots 34 go beyond the upper edge of the side wall. In addition, the cover 30 can be temporarily locked by engaging the upper edge of the side wall within a space between optionally selected knots. As mentioned above, the longitudinal length of one knot is so determined as to be approximately equal to the width of one narrow groove-like recess 28. Therefore, the cover 30 can be slid by a distance generally equal to the width of the narrow groove-like recess 28 little by little, so that the cover 30 can be temporarily locked therein. Thus, the opening length of the cover 30 cane freely changed at user's option.

The length of one knot in the longitudinal direction of the case corresponds to the distance by which the cover 30 travels per one click of the knot. Accordingly, a change in the length of one knot in the longitudinal direction can vary the distance: by which the cover 30 travels per one click. For example, it is possible to allow the cover 30 to slide per one click a distance which corresponds to a width corresponding to two or three narrow groove-like recesses. Also, it is, of course, possible to set the cover 30 so as to travel more than the distance.

A partition wall 26 is provided at a center of the case body 20 in the longitudinal direction so as to equally divide an interior space of the case into two chambers. This division is advantageous if different kinds of tablets are accommodated in the case. A cutout portion 26*a* is provided at an upper edge of the partition wall 26 so as to allow the knots 34 to pass therethrough when the cover 30 is slid.

In the cover 30 shown in FIG. 4, a projection 35 higher than the knot 34 is provided at a center of the row of knots. The projection 35 serves as a stopper means for preventing the overlapping length of the cover 30 and the case body 20 from becoming less than a half of the entire length of the tablet case. This stopper means will; be described below with reference to FIGS. 6 to 8, in which the cover 30 is drawn as transparent for better understanding of the functions of the knots 34 and the stopper projection 35. The transparent cover 30 is advantageous-in practical use because the kinds of tablets and their remaining amounts within the case can be confirmed even when the cover 30 is closed.

Figure 6:
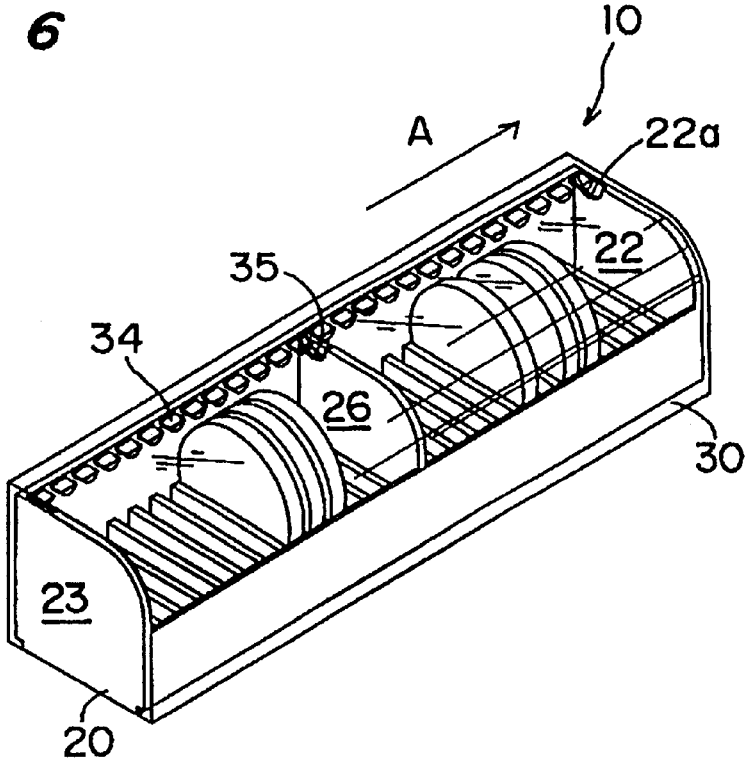
FIG. 6 is a perspective view of the tablet case shown in FIG. 2 when it is in a closed condition, where the cover is shown as transparent.

FIG. 6 is a perspective view of the assembled tablet case 10, showing a condition in which the case 10 is closed. The stopper projection 35 is positioned in the cutout portion 26*a* which is formed at the upper edge of the partition wall 26. The dimension of the cutout portion 26*a* is so set as to permit not only the knots 34 but also the projection 35 to pass therethrough. When the cover 30 is slid in a direction of an arrow "A" from the condition shown in FIG. 6, each of the knots 34 clicks successively every time they go beyond the upper edge of the side wall 22, and the cover 30 moves to a position shown in FIG. 7.

Figure 7:
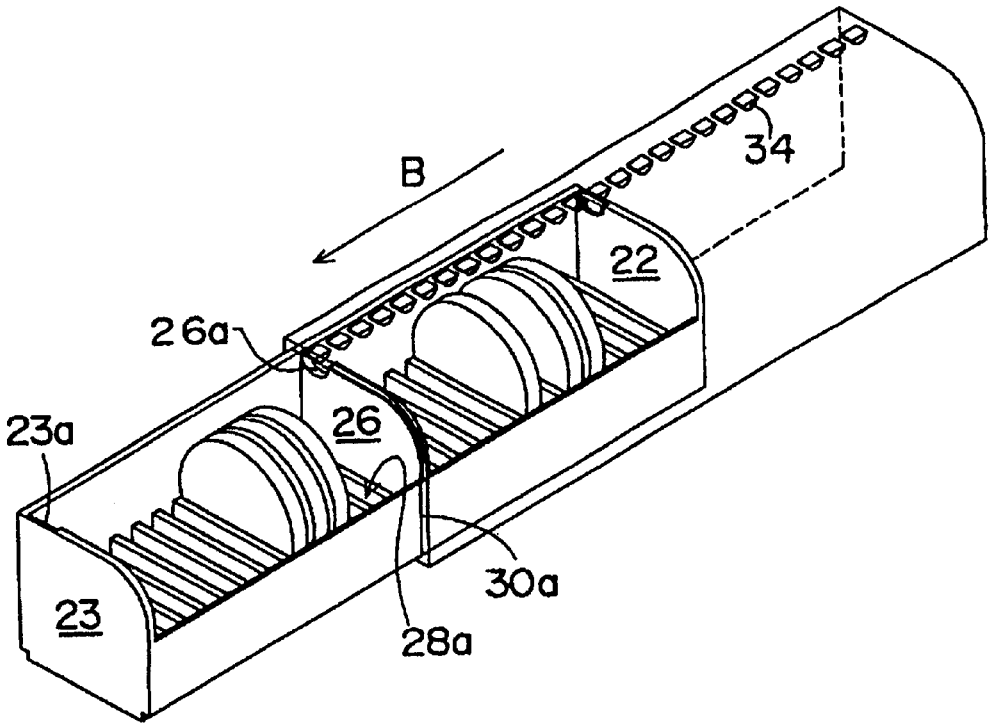
FIG. 7 is a perspective view of the tablet case of which the cover is slid from the condition shown in FIG. 6.

When the cover 30 is slid to the position shown in FIG. 7, the stopper projection 35 comes into contact with an inner face of the side wall 22 and prevent the cover 30 from further moving. It is for this preventive function that the stopper projection 35 is formed higher than the knots 34. That is, the knots 34 are formed lower so that they can go beyond the upper edge of the side wall 22 by elastically deforming the cover 30 or the side wall 22 to a certain degree. On the other hand, the stopper projection 35 is formed higher so that it can come into contact with the inner face of the side wall 22 and stop the cover 30.

Figure 8:
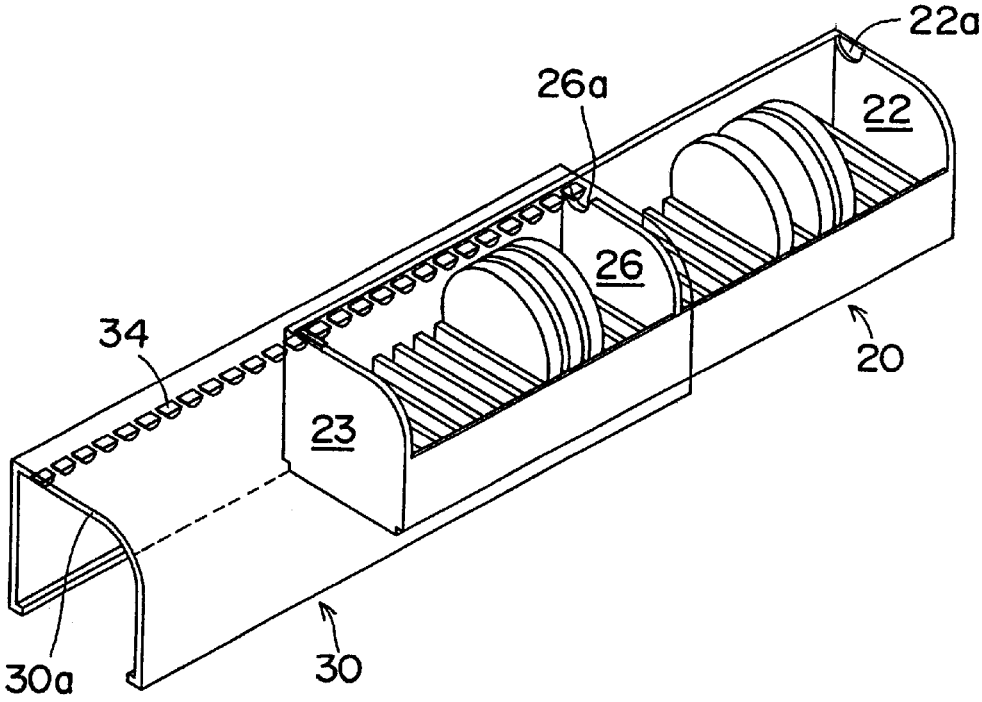
FIG. 8 is a perspective view of the tablet case of which the cover is slid in the opposite direction from the condition shown in FIG. 7.

As seen in FIG. 8, the side wall 22 has a recess 22*a* which is formed by making thinner a part of the upper edge portion of the side wall 22. In FIG. 7, the stopper projection 35 fits in the recess 22*a*. Thus, the longitudinal edge 30*a* of the cover 30 comes sufficiently near to the partition wall 26, so that the user can readily take out, with fingers, a tablet accommodated within a narrow groove-like recess 28*a* positioned most nearly to the partition wall. In FIG. 7, in the recess 28*a*, no tablet is held.

When the cover 30 is slid oppositely from the condition shown in FIG. 7 in a direction of an arrow "B", the cover 30 moves to a position shown in FIG. 8 while giving the user the clicking feel likewise as above. A recess 23*a* (see FIG. 7) as above is also formed at an inner face of the side wall 23 on this side in FIG. 8, and the cover 30 is stopped at a position shown in FIG. 8 in the same manner as described above. In the present invention, the positions where the knots 34 are formed are not specifically limited. However, in the case where, as shown in the figures, the knots 34 are provided on the inner face of the top wall of the slidable cover 30, the knots 34 are formed at such positions that the knots 34 never come into contact with tablets while the cover 30 is being slid.

As described above, the cover 30 is slidable only within a range between the position shown in FIG. 7 and the position shown in FIG. 8. Therefore, the overlapping length of the cover 30 and the case body 20 never becomes less than a half of the entire length of the tablet case. In addition, the sliding directions of the cover 30 differ from each other, between when one of the chambers is opened and when the other thereof is opened.

As described above, the stopper projection 35 advantageously functions particularly if the interior space of the case body is divided into two chambers. However, the stopper projection 35 may be provided even if the interior space of the case is not divided into two chambers. By providing the stopper projection 35, the overlapping length of the case body 20 and the cover 30 is prevented from being less than the half of the entire length of the case while all the tablets held in the narrow groove-like recesses within the case can be exposed outside. In contrast therewith, if no stopper projection 35 is provided in the cover, there is a disadvantage that the overlapping length of the case body and the cover 30 may become too short when the cover 30 is slid, and the cover 30 may unintentionally drop from the case body 20.

Figure 9:
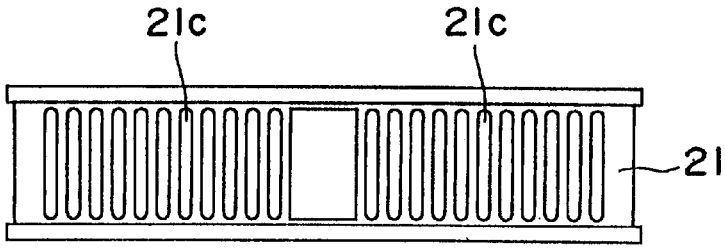
FIG. 9 is a bottom view of the tablet case shown in FIG. 2.

FIG. 9 shows a bottom surface of the tablet case 10. As seen in the sectional view of FIG. 5, the surface of the bottom wall 21 is made an uneven surface 21*c*, which functions as a grip means. In particular, when the user holds the tablet case 10 in one hand and slides the cover 30 with a finger, the uneven surface prevents the finger from slipping on the tablet case. Of course, the geometrical configuration of the uneven surface is not limited to that shown in the figures, and such an uneven surface may be provided on the surface of the cover 30.

In the foregoing embodiment, the clicking means has "the knots 34 provided on the inner face of the top wall 31 of the cover" and "the side wall 22 or 23 of the case body". However, the clicking means of the present invention is not limited to a particular one, and it may be any one that has a mechanism capable of providing a clicking feel and sound while the cover is slid relative to the case body. For example, knots similar to those as described above may be provided on a surface of the front wall 24 of the case body, and a projection capable of cooperating with such knots to provide a clicking feel and sound may be provided on an inner face of the front wall 32 of the cover. Further, the stopper means does not necessarily have the stopper projection 35 disposed at the center of the row of knots, and it may be other mechanisms capable of providing a similar effect.

What is claimed is:

1. A tablet case which is elongate and which accommodates a plurality of tablets (5), characterized in that there are provided:

a case body (20) which is provided with a plurality of slot grooves (28) each of which accommodates a tablet, wherein the plurality of slot grooves are arranged in a row in a longitudinal direction of the case body with a state in which the plurality thereof are in parallel with each other;

a cover (30) which is slidably mounted on the case body having a pair of ends in the longitudinal direction of the case body, and which extends from one of the pair of ends to the other of the ends of the case body in the longitudinal direction;

a locking means (34, 22, 23) for temporarily locking the case body and the cover relative to each other every time the cover (30) is slid by a predetermined distance relative to the case body;

wherein a partition wall (26), which divides an interior space of the tablet case into two chambers, is provided at a central part of the longitudinal direction of the case body (20), wherein there is provided a stopper means (35, 22, 23) with which an overlapping length of the cover (30) and the case body (20) is stopped from being pulled out of more than a half of an entire length of the tablet case.

2. The tablet case according to claim 1, wherein the predetermined distance is approximately equal to a width of each of the slot grooves (28).

3. The tablet case according to claim 1 or 2, wherein a plurality of knots (34) are linearly provided on an inner surface of the cover over an entire length in the longitudinal direction, wherein each of the plurality of knots has a length substantially equal to the predetermined distance in the longitudinal direction of the tablet case, and wherein the knots are engaged with an edge of side walls (22, 23) which are provided at the pair of ends of the case body in the longitudinal direction, thereby the knot functioning as the locking means.

4. The tablet case according to claim 3, wherein said stopper means comprises a projection (35), which is higher than the knots (34) linearly provided, provided at a center of the knots, and which functions to stop the case body by contacting with one of the side walls (22, 23).

5. The tablet case according to claim 3, wherein a clicking means is provided by said plurality of knots moving against said edges of side walls.

6. The tablet case according to claim 1, wherein in that a grip means (21*c*) is provided on at least one of a surface of the case body (20) and a surface of the cover (30) to help a user hold the tablet case.

7. The tablet case according to claim 6, wherein said grip means comprises an uneven surface on said case body.

8. The tablet case according to claim 6, wherein said grip means comprises an uneven surface on said cover.

* * * * *